United States Patent [19]

Kanowsky et al.

[11] 4,080,675

[45] Mar. 28, 1978

[54] CUSHION CONSTRUCTION

[75] Inventors: Vincent C. Kanowsky, Newport Beach; Raoul Canas, Buena Park, both of Calif.

[73] Assignee: Allied Upholstery Mfg., Inc., Lynwood, Calif.

[21] Appl. No.: 664,959

[22] Filed: Mar. 8, 1976

[51] Int. Cl.[2] ..... A47C 23/00

[52] U.S. Cl. ..... 5/345 R; 5/361 B; 5/341; 5/338

[58] Field of Search ..... 5/337, 338, 345, 355, 5/361, 361 B

[56] References Cited

U.S. PATENT DOCUMENTS

| | | | |
|---|---|---|---|
| 2,234,506 | 3/1941 | Sistig | 5/338 |
| 2,619,659 | 12/1952 | Futterknecht | 5/361 R |
| 2,815,515 | 12/1957 | McKinley | 5/341 |
| 3,083,496 | 4/1963 | Feinerman | 5/341 |

*Primary Examiner*—Paul R. Gilliam
*Assistant Examiner*—Victor N. Sakran
*Attorney, Agent, or Firm*—Harris, Kern, Wallen & Tinsley

[57] ABSTRACT

A cushion for a sofa or chair or the like, preferably formed of a polyurethane foam pad and a vinyl cover. Buttons are incorporated to provide dimples in the cover. The buttons are the heads of pins which project into the pad and are fastened in place at a separation in the pad. The pad may be slit to provide the separation or may be made in two pieces sandwich style. A filler of lesser width and length than the pad may be positioned within the pad at the separation to provide a crown for the cushion.

4 Claims, 5 Drawing Figures

CUSHION CONSTRUCTION

BACKGROUND OF THE INVENTION

This invention relates to cushions having top and bottom, sides and ends, of the type generally used for sofas, chairs and the like.

Present day cushions typically are manufactured with a pad of polyurethane foam or similar material placed inside a cover made of leather, vinyl or fabric. A zipper closure normally is utilized for closing the cover about the pad. Batting or a wrap may be provided between the pad and cover. Typical batting materials include loose polyester, bonded fiber or other resilient materials. The batting provides some initial resilience but is not very effective because it tends to compact rather quickly. Most of the resilience in the cushion is obtained with the pad. Buttons are often used to produce a dimple pattern and are often found with cushions having leather or imitation leather covers. The buttons typically are held in place by a cord which passes from the top to the bottom of the cushion. This mode of installing buttons has not been satisfactory because the continuous tension provided by the cord tends to pull the button through the cover into the interior of the cushion.

It is an object of the present invention to provide a new and improved cushion construction particularly suited for cushions with foam pads and thin vinyl covers. A further object is to provide a cushion construction incorporating a new button installation whereby buttons can be positioned on both top and bottom of the cushion without being interconnected and without being subject to pulling through the cover. Another object is to provide such a cushion construction where buttons can be installed at the sides and ends as well as the top and bottom of the cushion. An additional object is to provide a new and improved cushion construction which obtains a crown or convex shape for the cushion while utilizing conventional pads with parallel top and bottom.

SUMMARY OF THE INVENTION

A cushion is formed of a pad and a cover, with the pad having a central separation, as by a slit in a single piece or by two separate pieces. The pad may be a standard section of foam with parallel top and bottom and a crown or convex configuration is achieved by inserting a filler at the central separation, with the filler having a lesser width and length than the pad. Buttons may be provided on the top, bottom and sides of the cushion as desired. A button comprising a head and body has the body portion inserted from the exterior through the cover to the central separation, with a fastener engaging the body to hold the button in position. Typically the button body comprises parallel metal strips which pass through an opening in the fastener and are bent oppositely with the pad compressed between the head and fastener forming a dimple in the cushion.

DESCRIPTION OF THE PREFERRED EMBODIMENTS

Figure 1:
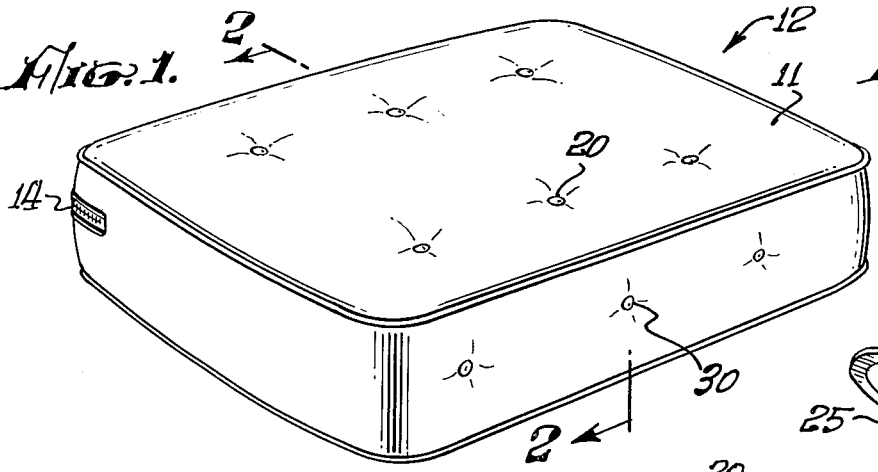
FIG. 1 is a perspective view of a cushion incorporating the presently preferred embodiment of the invention.
Figure 2:
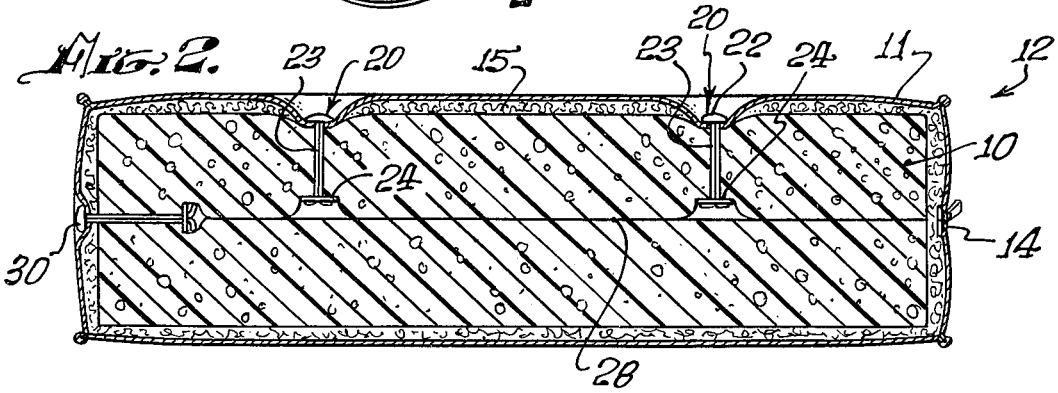
FIG. 2 is an enlarged sectional view taken along the line 2–2 of FIG. 1.

In the embodiment of FIGS. 1 and 2, a pad 10 is positioned within a cover 11 to form the cushion 12. The pad is made of a resilient material and polyurethane foam is a presently preferred material. A typical cushion may be 20 to 24 inches wide, 20 to 40 inches long, and 4 to 8 inches thick.

The cover 11 is formed in the usual manner from a sheet of leather or vinyl or fabric or other material by cutting and sewing. An opening along one side is provided for inserting the pad into the cover and the opening is usually closed by a zipper 14. If desired, a quantity of batting or wrapping 15 may be provided around the pad between the pad and cover. Typical batting material includes loose polyester or bonded fiber or other resilient materials. The batting is not essential to the cushion construction.

Figure 5:
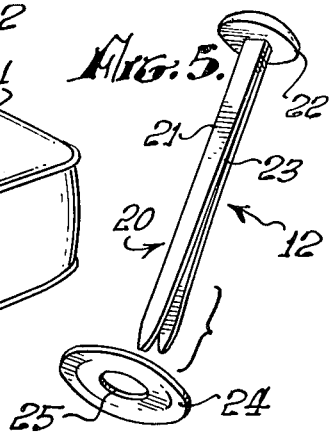
FIG. 5 is a perspective view of a button pin and fastener suitable for use in the cushion of FIG. 1.

The construction described thus far is conventional, with the pad 10 normally being a single block of material. In the embodiment illustrated, buttons 20 are provided in the cushion using the desired dimpled configuration. The button 12 as shown in FIG. 5 comprises a pin 21 with a head 22 and a body 23, and a fastener 24. Typically the pin is formed of metal with the body comprising two metal strips. The fastener 24 typically is formed of metal in the form of a disc with an opening 25.

In the embodiment of FIGS. 1 and 2, the pad 10 is slit down the middle to provide a central separation 28. The pad is inserted into the cover with the open side of the slit of the pad adjacent the opening in the cover. The locations for the buttons are indicated by small holes in the cover. A button is installed on the cushion by slipping the button body 23 through the hole in the cover 11 and pushing the button body through the pad. When the end of the button body emerges at the central separation, the fastener 24 is placed over the button body to the desired distance and the two pieces are bent over in opposite directions as shown in FIG. 2. The button is now retained in place in the cushion in a highly satisfactory manner and there is little tendency for the head 22 to pull through the cover, even with present day thin vinyl material.

Figure 3:
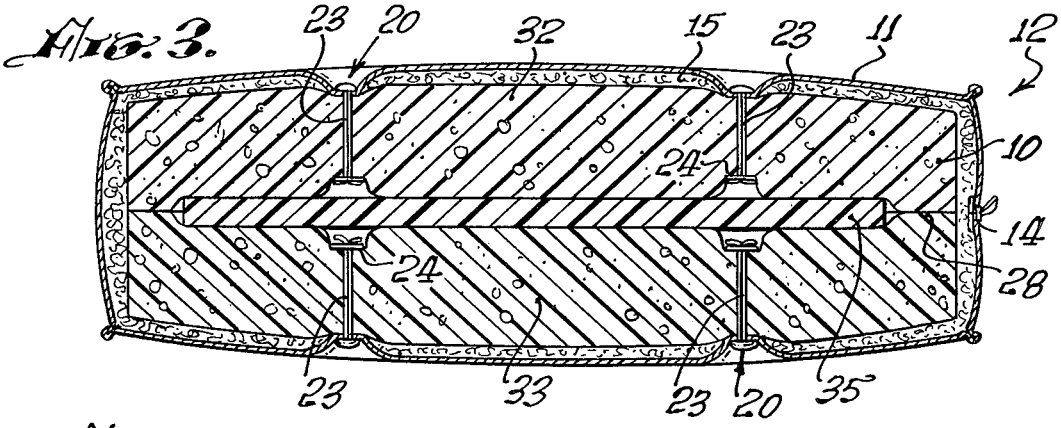
FIG. 3 is a view similar to that of FIG. 2 showing an alternative construction for the cushion.

Buttons may be inserted through the top as shown in FIGS. 1 and 2. Buttons may also be inserted through the bottom if desired, as shown in FIG. 3. Buttons may also be inserted from the side, as shown at 30 in FIGS. 1 and 2. Here the button body is pushed through the side of the pad and enters the central separation. The button installer reaches through the opening of the cover and down through the central separation 28, expanding the separation sufficient to enable him to place the fastener over the button body and spread the body members to retain the fastener in place.

Several alternative features are shown in FIG. 3. As previously mentioned, buttons may be inserted from the top and from the bottom if desired. In the embodiment of FIG. 3, the pad 10 is formed of two separate pieces 32, 33 which are positioned one ontop of the other in sandwich style.

Figure 4:
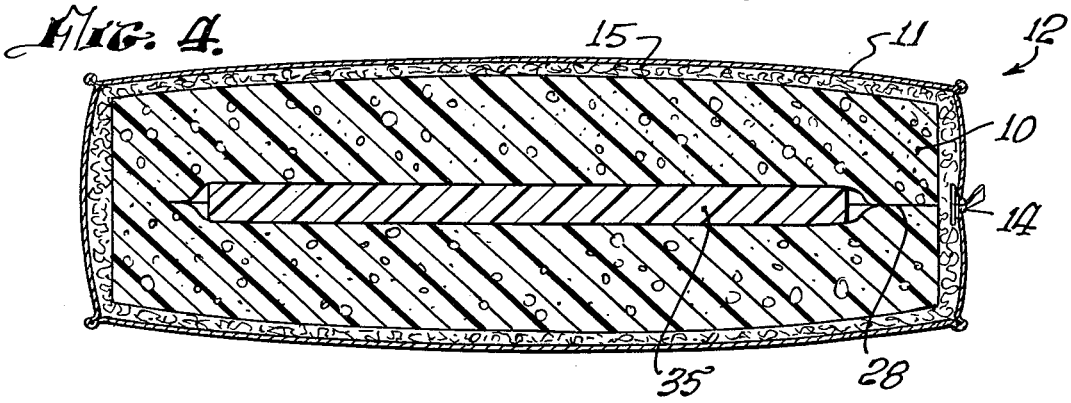
FIG. 4 is a view similar to that of FIG. 2 showing another alternative construction for the cushion.

In some designs, a relatively flat top and bottom is desired for the cushion. This is readily achieved by utilizing standard foam stock which may be purchased with parallel top and bottom. The single pad piece with slit or the two piece pad constructon may be used. However other furniture designs call for a crown or convex shape for the cushion. One way of achieving the crown shape is to cast the foam pad with the desired crown configuration. However this is expensive, requiring a separate mold for each cushion size. Another mode for achieving a crown has been to introduce a quantity of batting in the central portion of the cushion between the cover and pad. However this has not been satisfactory because the batting loses its resiliency and compacts after a relatively short time. FIGS. 3 and 4 show a new arrangement for obtaining the crown configuration which may be used with the two piece pad as shown in FIG. 3 and with the single piece slit pad as shown in FIG. 4.

In the cushion of FIG. 3, a filler 35 is positioned between the pieces 32, 33. The filler may be standard stock foam with parallel top and bottom and of a thickness to give the desired amount of crown. The filler is made with a length and width less than that of the pad so that the cushion's thickness is increased in the central portion but not at the edges. Typically the length and width dimensions of the filler 35 may be in the order of 2 inches to 4 inches less than the corresponding dimensions of pad 10. A filler may be used with the construction of FIG. 2 if desired. Alternatively, the crown construction may be utilized without buttons, with a slit single pad as shown in FIG. 4 or with a two piece pad.

We claim:

1. In a movable cushion having a top, a bottom and four sides, the combination of:

a pad comprising a block of cushion material with a central separation parallel to said top and bottom through at least one side of said block and defining upper and lower portions of said block;

a cover enclosing said pad and having an opening in one side for insertion and removal of said pad, said separation at said one side of said block being adjacent said opening; and a plurality of buttons providing dimples in said cover, each of said buttons comprising a pin with head and body, with the head on the exterior of said cover and with the body projecting through said cover and one of said upper and lower portions of said block only into said central separation of said pad, and a fastener in said separation engaged with the inner end of said pin, with said fastener and inner end of said pin accessible through said cover opening.

2. A cushion as defined in claim 1 with a button through a side of said cover and projecting through the pad to one edge of said slit, with the button fastener in the slit, said pad being formed of one piece with a slit substantially parallel to the face of said pad and part way through said pad.

3. A cushion as defined in claim 1 with at least one of said buttons positioned at the top of the cushion and extending to said central separation, and with at least one of said buttons positioned at the bottom of the cushion and extending to said central separation.

4. A cushion as defined in claim 2 with at least one of said buttons positioned at the top of the cushion and extending to said slit, and with at least one of said buttons positioned at a side of the cushion and extending to one edge of said slit.

* * * * *